US009765555B2

(12) United States Patent
Evans et al.

(10) Patent No.: US 9,765,555 B2
(45) Date of Patent: Sep. 19, 2017

(54) VOCATIONAL HOOD LATCH ASSEMBLY

(71) Applicants: Nicholas J. Evans, Lewisville, TX (US); Wallace A. Peltola, Sammamish, WA (US); Jonathan Duncan, Seattle, WA (US)

(72) Inventors: Nicholas J. Evans, Lewisville, TX (US); Wallace A. Peltola, Sammamish, WA (US); Jonathan Duncan, Seattle, WA (US)

(73) Assignee: PACCAR INC, Bellevue, WA (US)

( * ) Notice: Subject to any disclaimer, the term of this patent is extended or adjusted under 35 U.S.C. 154(b) by 92 days.

(21) Appl. No.: 14/464,398

(22) Filed: Aug. 20, 2014

(65) Prior Publication Data

US 2016/0053518 A1 Feb. 25, 2016

(51) Int. Cl.

| | |
|---|---|
| ***B65D 45/00*** | (2006.01) |
| ***E05B 83/24*** | (2014.01) |
| ***E05C 19/14*** | (2006.01) |
| *E05C 5/00* | (2006.01) |

(52) U.S. Cl.

CPC ..... *E05B 83/243* (2013.01); *E05C 19/14* (2013.01)

(58) Field of Classification Search

CPC ..... E05B 83/16; E05B 83/24; E05B 83/243; E05C 19/14

USPC .. 292/97, 247, 56, 250, 63, 64, 66, 95, 109, 292/113, 116, 118, 194, 213, 217, 200, 292/256, 241, 101, 256.5, 256.69, 292/DIG. 14, DIG. 38, DIG. 49

See application file for complete search history.

(56) References Cited

U.S. PATENT DOCUMENTS

| | | | | |
|---|---|---|---|---|
| 1,758,988 A * | 5/1930 | Turnwald | ..... | E05B 83/243 292/25 |
| 1,827,319 A | 10/1931 | Komenak | | |
| 2,818,596 A | 1/1958 | Martinec | | |
| 3,025,094 A * | 3/1962 | Buchanan | ..... | F21V 17/20 16/232 |
| 3,466,076 A | 9/1969 | Bisbing | | |

(Continued)

FOREIGN PATENT DOCUMENTS

| | | | | |
|---|---|---|---|---|
| DE | 19804525 A1 * | 8/1999 | ..... | E05C 19/14 |

OTHER PUBLICATIONS

Computer Generated Translation for DE 19804525 A1, translated on Mar. 9, 2016, http://worldwide.espacenet.com.*

(Continued)

*Primary Examiner* — Alyson M Merlino
(74) *Attorney, Agent, or Firm* — Christensen O'Connor Johnson; Matthew Balint; John Denkenberger

(57) ABSTRACT

A latch assembly for a vehicle hood includes a hood mount securable to the hood. First and second recesses are formed in the hood mount. The latch assembly includes a cab mount assembly having a mounting bracket, a link, and a handle. The mounting bracket is securable to the cab, and the link has a first end rotatably coupled to the mounting bracket. The handle has a first end rotatably coupled to a second end of the link about a first axis. The handle further includes a trunnion extending laterally from each of two sides of the handle to define a second axis. As the latch assembly moves from an unlatched position to a latched position, each of the trunnions engages one of the first and second recesses in the hood mount so that the handle rotates relative to the hood mount about the second axis.

8 Claims, 8 Drawing Sheets

(56) References Cited

U.S. PATENT DOCUMENTS

| | | | | | |
|---|---|---|---|---|---|
| 3,628,817 | A | * | 12/1971 | Sheahan | E05C 19/14 292/247 |
| 3,654,453 | A | * | 4/1972 | Jablonski | F21S 8/086 292/247 |
| 3,985,380 | A | | 10/1976 | Raivio | |
| 4,184,705 | A | | 1/1980 | Little | |
| 4,540,206 | A | | 9/1985 | Frame | |
| 4,705,308 | A | | 11/1987 | Bisbing | |
| 4,782,673 | A | | 11/1988 | Castelli | |
| 4,830,413 | A | | 5/1989 | Bisbing | |
| 5,024,471 | A | | 6/1991 | Kahl | |
| 5,127,684 | A | | 7/1992 | Klotz | |
| 5,607,195 | A | * | 3/1997 | Antonucci | E05B 63/0056 292/247 |
| 5,624,142 | A | | 4/1997 | Watson | |
| 5,826,672 | A | | 10/1998 | Holter | |
| 5,890,556 | A | | 4/1999 | Shearn | |
| 6,073,979 | A | | 6/2000 | Nawalaniec | |
| 6,217,835 | B1 | | 4/2001 | Riley | |
| 6,257,631 | B1 | | 7/2001 | Sokurenko | |
| 6,345,846 | B1 | | 2/2002 | DeRees | |
| 6,457,750 | B1 | | 10/2002 | Sokurenko | |
| 7,017,955 | B1 | | 3/2006 | Chiang | |
| 8,408,608 | B2 | | 4/2013 | Wilkens | |
| 2002/0166707 | A1 | | 11/2002 | Palenchar | |
| 2006/0207817 | A1 | | 9/2006 | Tucker | |

OTHER PUBLICATIONS

International Search Report and Written Opinion mailed Feb. 2, 2011, issued in corresponding International Application No. PCT/US2010/059308, filed Dec. 7, 2010, 7 pages.

* cited by examiner

VOCATIONAL HOOD LATCH ASSEMBLY

BACKGROUND

Heavy-duty trucks typically include a chassis, an engine and a cab mounted to the chassis, and a hood for enclosing the engine. It is often desirable to have an air suspension system or other suitable system that allows the cab to move independently of the chassis to provide the driver and passengers with added comfort. More specifically, the cab normally moves fore and aft and up and down relative to the chassis in response to changing conditions on the road.

A conventional heavy duty truck has a large, engine-covering hood that tilts about a transverse pivot axis located above the bumper to expose the engine for servicing. The hood may be mounted at its forward end to the forward end of the chassis, and the hood may be mounted at its rear end to a portion of the cab. Fixed connections between the chassis and the cab (through the hood) prevent the fore and aft cab movement and the up and down cab movement required of the cab suspension system. Thus, it is desirable to have a hood mounting system that secures the hood to the cab in a manner that accommodates the movement of the cab relative to the hood and chassis.

SUMMARY

A disclosed exemplary embodiment of a latch assembly is suitable for detachably securing a vehicle hood to the cab of the vehicle. The latch assembly includes a hood mount that is securable to a portion of the hood. First and second recesses are formed in the hood mount. The latch assembly further includes a cab mount assembly. The cab mount assembly has a mounting bracket, a link, and a handle. The mounting bracket is securable to a portion of the cab, and the link has a first end rotatably coupled to the mounting bracket. The handle has a first end rotatably coupled to a second end of the link about a first axis. The handle further includes a trunnion extending laterally from each of two sides of the handle to define a second axis. As the latch assembly moves from an unlatched position to a latched position, each of the trunnions engages one of the first and second recesses in the hood mount so that the handle rotates relative to the hood mount about the second axis.

Also disclosed is a vehicle having a chassis, a cab mounted to the chassis, a hood positioned adjacent to the cab, and a latch assembly for securing the hood to the cab. The latch assembly includes a hood mount coupled to the hood, wherein a first recess and a second recess are formed in the hood mount. The latch assembly also includes cab mount assembly comprising a mounting bracket, a link, and a handle. The mounting bracket is coupled to the cab, and the link is rotatably coupled to the mounting bracket. The handle is also rotatably coupled to the link about a first axis. A trunnion extends laterally from each of opposite sides of the handle to define a second axis, and each of the trunnions engages one of the first and second recesses in the hood mount as the latch assembly moves from an unlatched position to a latched position. As the latch assembly moves from the latched position to the unlatched position, the handle rotates relative to the hood mount about the second axis.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
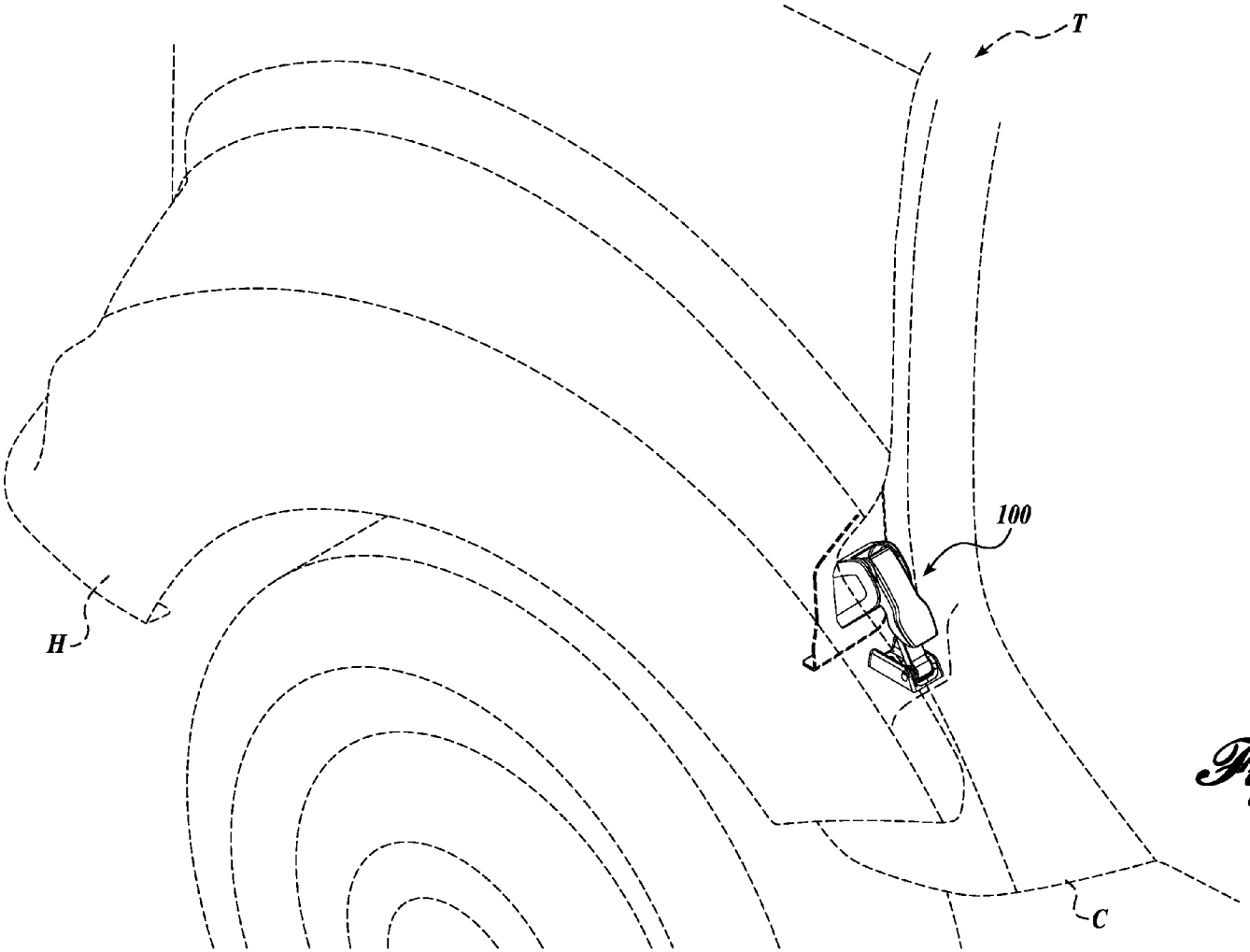
FIG. 1 is an environmental view of a representative embodiment of a hood latch assembly shown in a latched position, coupling a hood to a portion of a vehicle.
Figure 2:
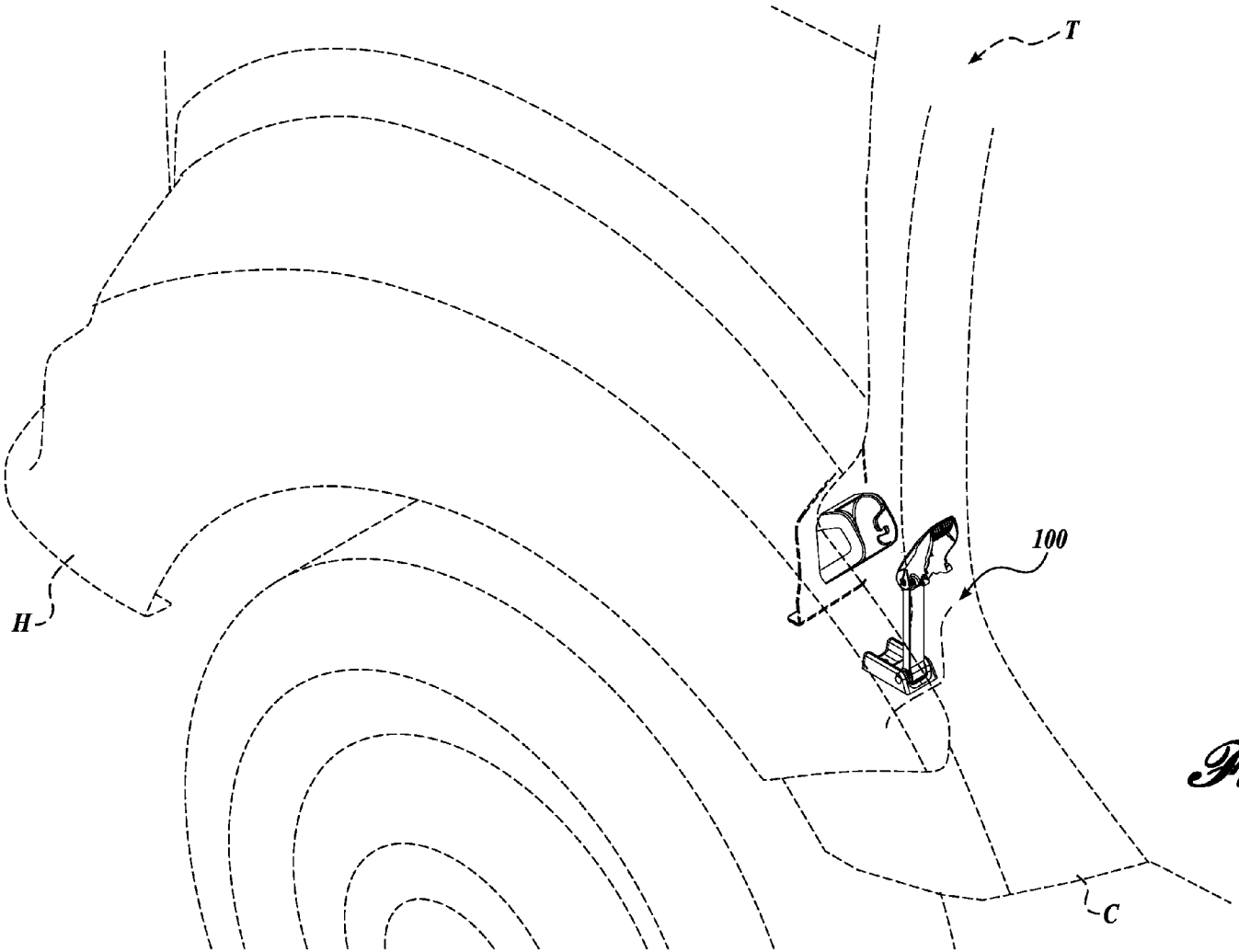
FIG. 2 is an environmental view of the hood latch assembly of FIG. 1 shown in an unlatched position.

A latch assembly 100 constructed in accordance with one embodiment of the present disclosure is best seen by referring to FIGS. 1 and 2. The latch assembly 100 is shown in use with a heavy duty truck T having a cab C, a chassis (not shown), and a hood H. The hood H is pivotally coupled at its forward end to the chassis through a suitable hinge assembly (not shown) that is well known in the art. The hood H pivots about the hinge assembly to move between open and closed positions.

The latch assembly 100 is used to securely mount the hood H to the cab C at a rearward portion of the hood H. It should be appreciated that any preferred hood and cab design may be used; and, therefore, the hood H and cab C shown in FIG. 1 should be seen as illustrative only and should not be taken as limiting the scope of the present disclosure. Moreover, from time to time throughout the description, directional terms, such as "upper," "lower," "clockwise," "counterclockwise," etc., may be used for ease of description of the latch assembly 100. It should be appreciated that such terms are for illustrative purposes only and should not be taken as limiting the scope of the present disclosure.

Figure 3:
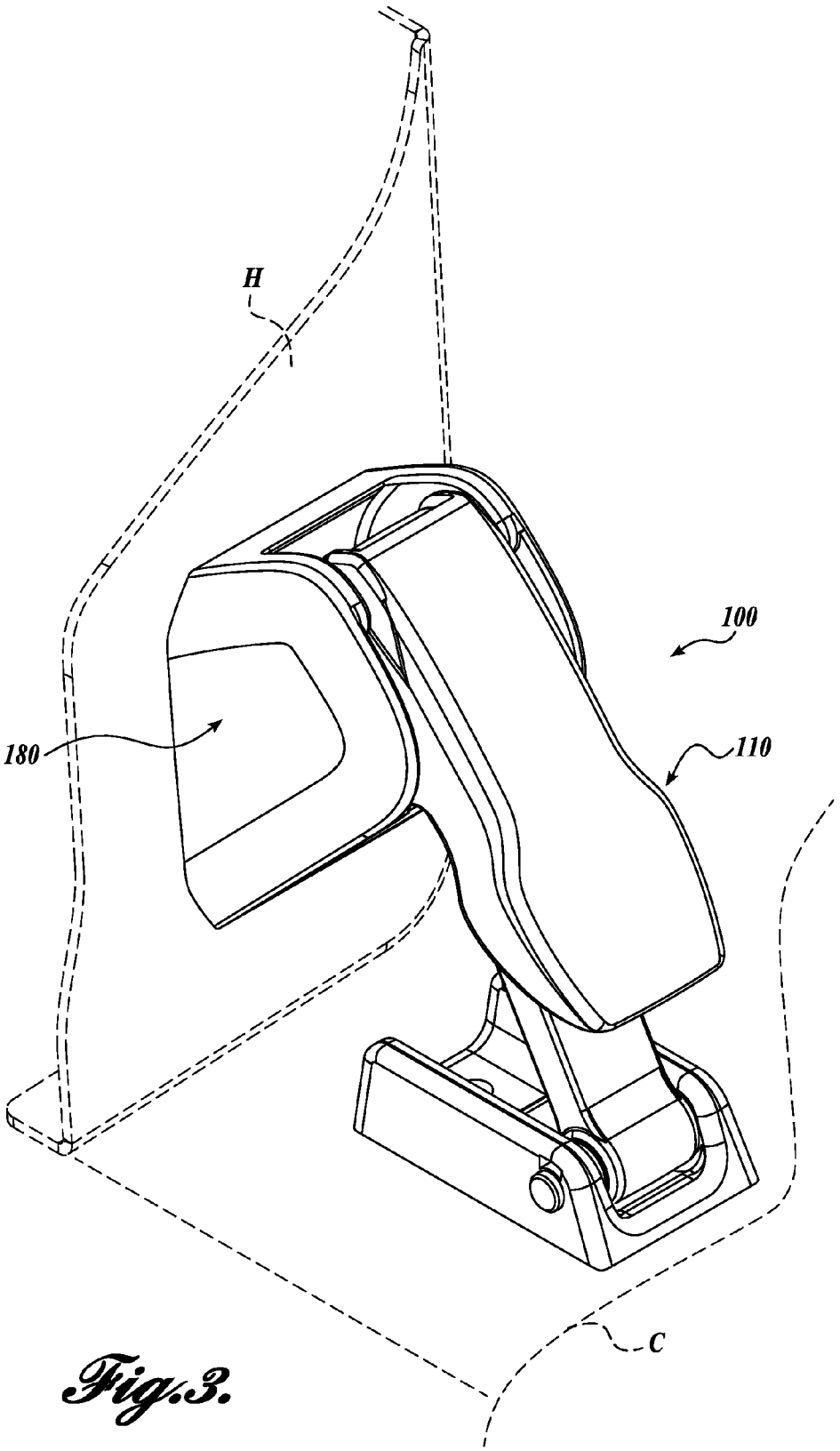
FIG. 3 is an isometric view of the hood latch assembly of FIG. 1 shown in the latched position.
Figure 4:
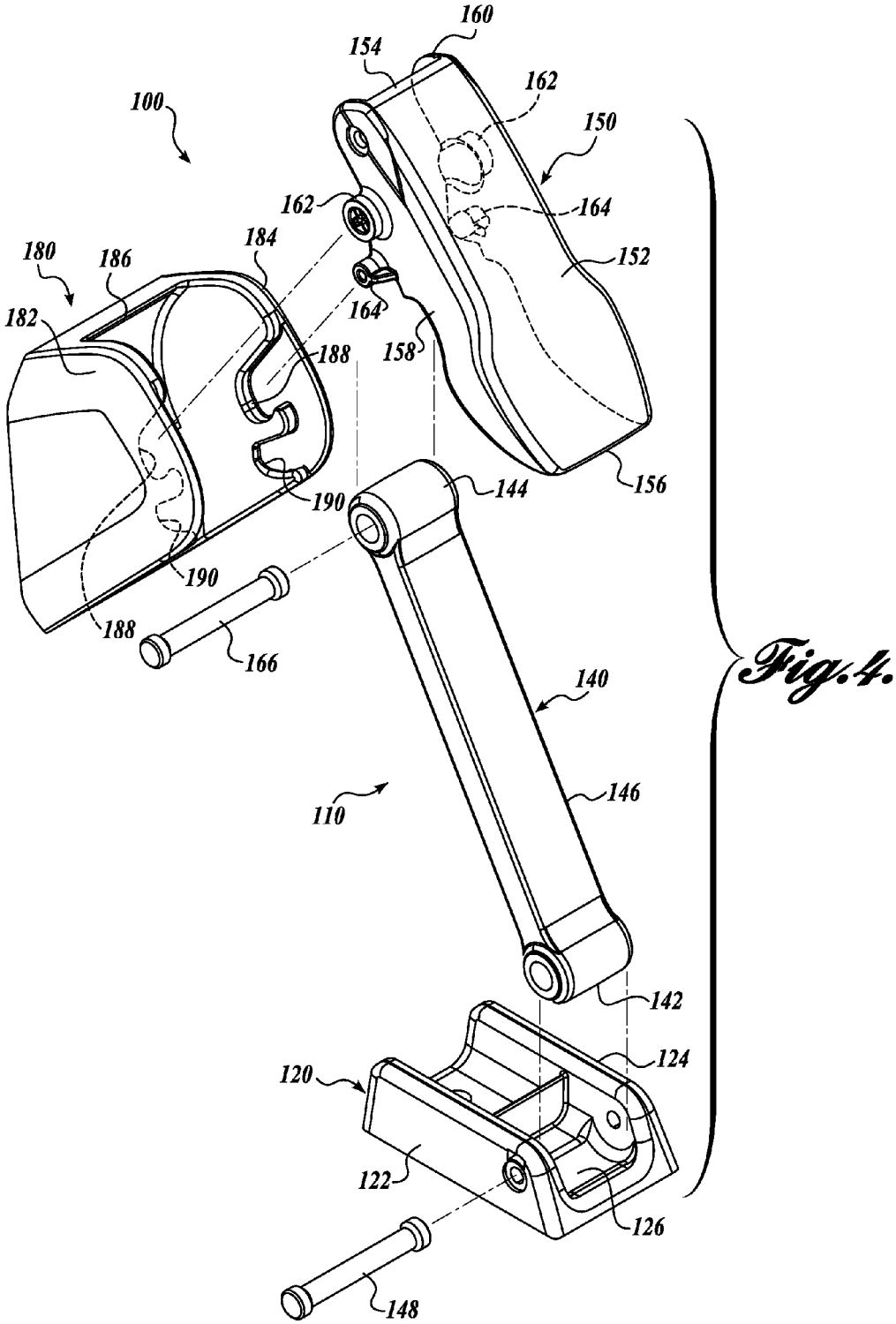
FIG. 4 is an exploded isometric view of the hood latch assembly of FIG. 1.

Referring to FIGS. 3 and 4, the latch assembly 100 will now be described in more detail. The latch assembly 100 includes a cab mount assembly 110 securable to a portion of the cab C and a hood mount 180 securable to a portion of the hood H. The cab mount assembly 110 is releasably securable to the hood mount 180 to secure the hood H to the cab C.

Referring now to FIG. 4, the cab mount assembly 110 includes a mounting bracket 120, a link 140, and a handle 150. The U-shaped mounting bracket 120 has first and second ears 122 and 124 and a transverse portion 126 extending between lower ends of the first and second ears 122 and 124. As shown in FIGS. 5-8, a portion of the mounting bracket 120 extends through a hole in the cab C and is fixedly coupled to a backing bracket 130 by one or more fasteners 132. The portion of the mounting bracket 130 extending through the hole is smaller than the hole to provide some adjustability to the position of the mounting bracket 130. It will be appreciated that the mounting bracket 120 may be secured to the cab C in any suitable manner and is not limited to the illustrated embodiment.

Referring back to FIG. 4, the link 140 is securable to the mounting bracket 120. Specifically, a first end 142 of the elastomeric link 140 is rotatably secured between the first and second ears 122 and 124 of the mounting bracket 120 by passing a pin 148 or other suitable fastener through the first and second ears 122 and 124 and the first end of the elastomeric link 140. The elastomeric link 140 is thus rotatable relative to the mounting bracket 120 about an axis 200 that is defined by the centerline of the pin 148.

The elastomeric link 140 includes an elongate body portion 146 extending from the first end 142 to a second end 144. The elongate body portion 146 is preferably made from an elastomeric material such that it at least somewhat deformable and stretchable; however, it should be appreciated that the entire elastomeric link may be made from an elastomeric material. The elastomeric link 140 may be made from any suitable elastomeric material, such as rubber. In this manner, the elongate body portion 146 may twist, bend, stretch, etc., when securing the cab mount assembly 110 to the hood mount assembly 180. This flexibility allows the elastomeric link 140 to accommodate misalignment between the hood H and the cab C or movement of the cab C with respect to the hood H, as will be described in further detail below. Moreover, with the first and second ends 142 and 144 made from an elastomeric material, the first and second ends 142 and 144 help dampen any vibration or movement at the first and second ends 142 and 144.

The handle 150 will now be described in detail. The handle 150 may be any suitable or desired overall shape such that it is graspable and moveable by a user. In the depicted embodiment, the handle 150 has an overall substantially rectangular shape with a hollow interior. Specifically, the handle 150 includes an elongate body 152 with a first end 154 and a second end 156, and first and second side portions 158 and 160 extending downwardly from opposite lateral edges of the elongate body 152.

The elongate body 152 and the first and second side portions 158 and 160 define a bottom opening such that at least a portion of the second end 144 of the link 140, as well as a portion of the link 140 itself, may be received within the hollow interior of the handle 150.

Two trunnions 162 extend from the opposite sides of the handle 150 along a common centerline 204. More specifically, a trunnion 162 extends outwardly from each of the first and second side portions 158 and 160 so that the trunnions share a common centerline 204. Each of the first and second side portions 158 and 160 of the handle 150 also has a stop element 164 extending outwardly therefrom. As will be explained in further detail, the stop elements 164 engage the hood mount 180 to help define a latched position.

The first end 154 of the handle 150 is rotatably attached to the second end 144 of the link 140. Specifically, the second end 144 of the link 140 is pivotally secured between the first and second side portions 158 and 160 of the handle 150 by passing a pin 166 or other suitable fastener through the first and second side portions 158 and 160 of the handle 150 and the second end 144 of the link 140. The link 140 is thus rotatable relative to the handle 150 about an axis 202, which is defined by the centerline of the pin 166.

In the disclosed embodiment, the pins 148 and 166 engaging the ends of the link 140 are parallel; however, it will be appreciated that the orientation of the pins and, therefore, the axes 200 and 202 defined by the pins need can vary from slightly, particularly in view of the elastomeric properties of the link 140. Accordingly, the pins 148 and 166 should be considered substantially parallel, and embodiments in which the orientations vary slightly while still allowing the latch assembly 100 to function as intended should be considered within the scope of the present disclosure. Further, the centerline 204 of the trunnions 162 is also shown to be parallel to the axes 200 and 202 of the pins 148 and 166. Similar to the axes 200 and 202, the orientation of the centerline 204 can vary relative to one or both of the axes and still enable the latch assembly 100 to function as intended, and such variations should be considered within the scope of the present disclosure.

Still referring to FIG. 4, the hood mount assembly 180, which is securable to a portion of the hood H using fasteners 192, is configured to mate with the cab mount assembly 110 to releasably secure the hood H to the cab C. The U-shaped hood mount assembly 180 has first and second ears 182 and 184 and a transverse portion 186 extending between lower ends of the first and second ears 182 and 184.

The inner side of each of the first and second ears 182 and 184 has a profile formed thereon. The profile defines a first recess 188 sized and configured to receive one of the trunnions 162 that extend from the sides of the handle 150. When the trunnions 162 are disposed in their respective recesses 188, the handle 150 is rotatable relative to the cab mount assembly 110 about the centerline of the trunnions 204. The profile further defines a second recess 190 sized and configured to receive the stop element 164 of the handle 150 to limit rotation of the handle relative to the hood mount assembly 180 when the trunnions 162 are disposed within the first recesses 188.

The hood mount assembly 180 may be made from any suitable material well known in the art. As a non-limiting example, the hood mount assembly 180 is made from a suitable plastic or similar material to minimize friction between the hood mount assembly 180 and the handle 150 when the latch assembly 100 is being open or closed.

Figure 5:
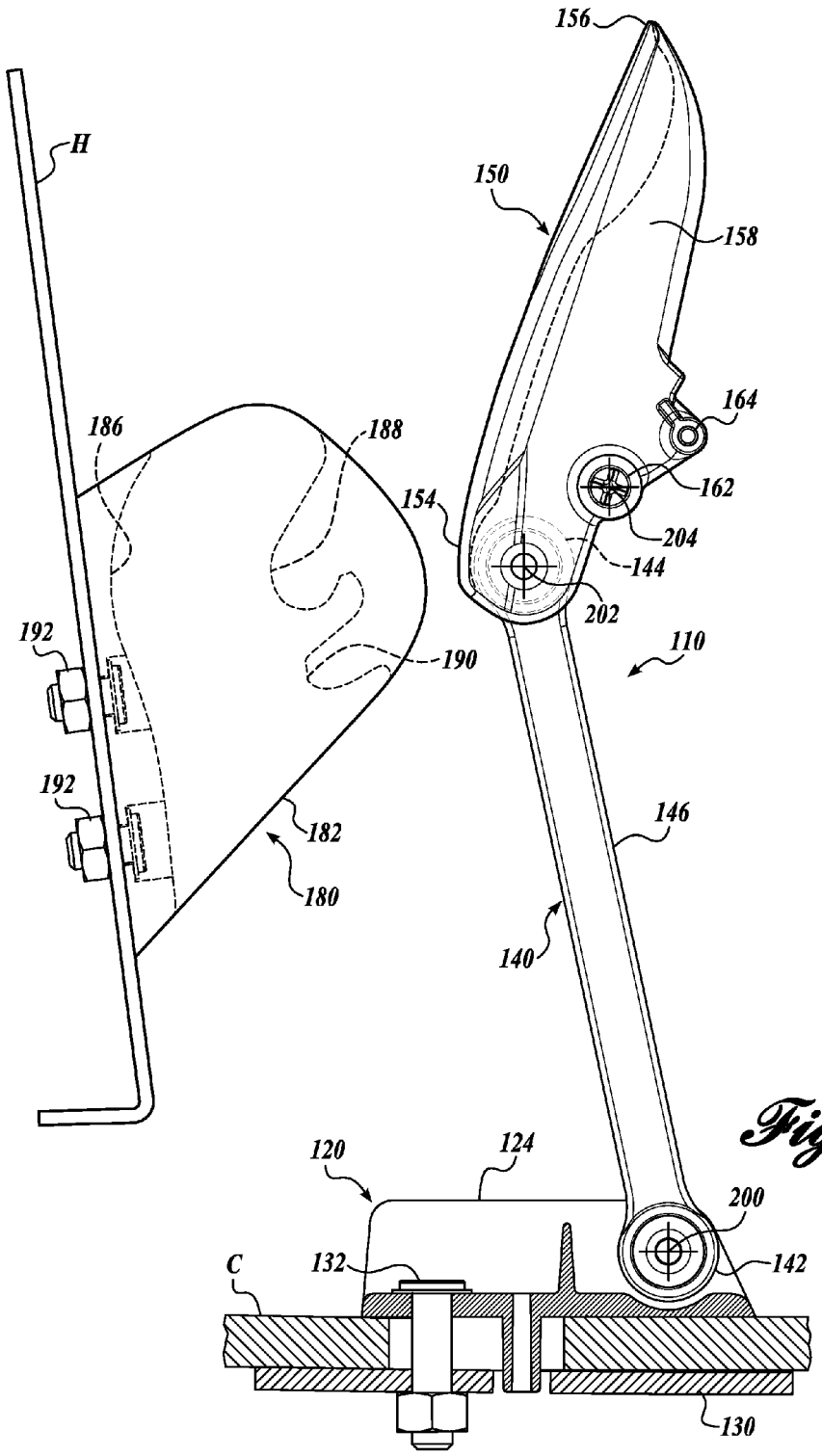
FIG. 5 is a cross-sectional view of the hood latch assembly of FIG. 1 shown in the unlatched position.

Referring to FIGS. 5-8, the operation of the hood latch assembly 100 for releasably securing the hood H to the cab C will be hereinafter described. FIG. 5 depicts the hood latch assembly 100 in an open, unlocked position with the hood H detached from the cab C. To move the hood latch assembly 100 into a closed, locked position, the handle 150 is lifted upwardly, and the link 140 is rotated about axis 200 to align the trunnions 162 with the first recesses 188 formed in the hood mount 180. Rotation of both the handle 150 and the link 140 allows a user to manipulate the cab mount assembly 110 to account for different hood H positions.

Figure 6:
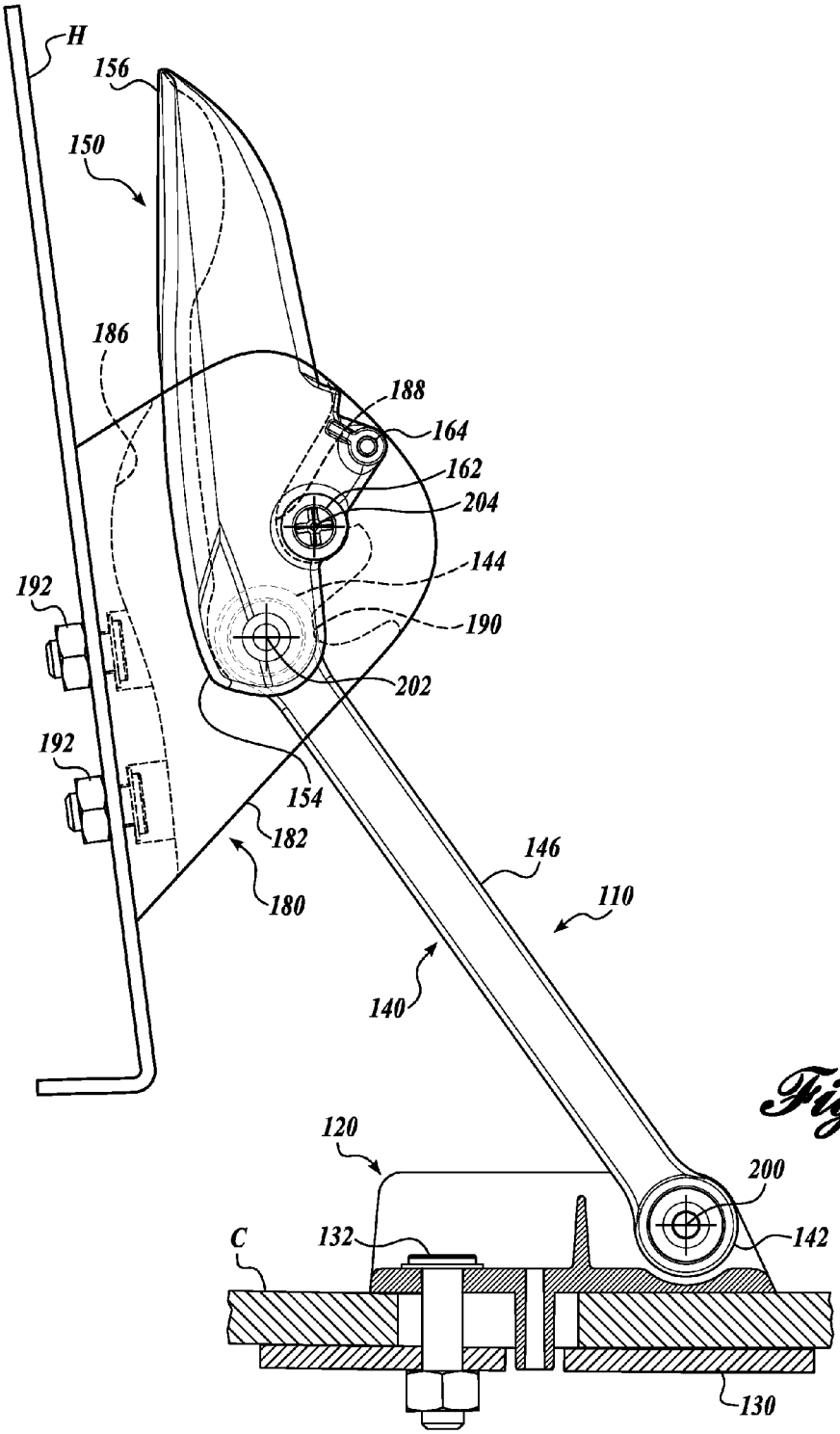
FIG. 6 is a cross-sectional view of the hood latch assembly of FIG. 1 shown in a first intermediate position.

With the trunnions 162 and first recesses 188 aligned, the handle 150 and link 140 are rotated to engage the trunnions 162 with the first recesses 188, as shown in FIG. 6. With the trunnions 162 disposed within the first recesses, the user applies a force to the second end 156 of the handle 150 to rotate the handle 150 in a clockwise direction (as shown in FIGS. 5-8) relative to the hood mount 180. More specifically, the handle 150 rotates relative to the hood mount 180 about the trunnion axis 204.

Figure 7:
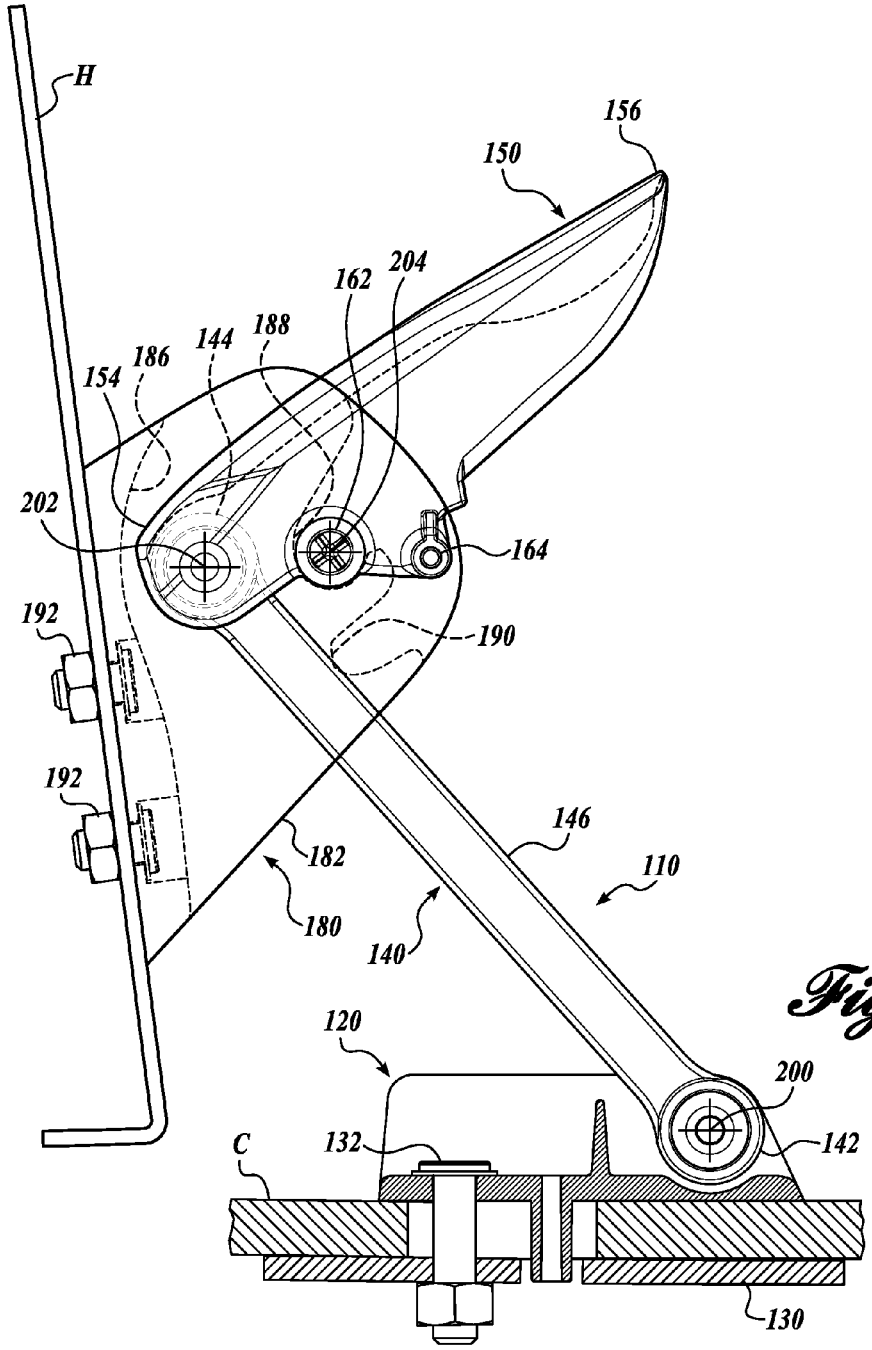
FIG. 7 is a cross-sectional view of the hood latch assembly of FIG. 1 shown in a second intermediate position.

As the handle 150 rotates relative to the hood mount 180, the connection of the handle to the link 140 about axis 202 drives the hood mount and, therefore, the hood H in a downward direction, as shown in FIGS. 6 and 7. Continued rotation of the handle 150 relative to the hood mount 180 in this manner continues until the stop elements 164 engage the second recesses 190 in formed in the hood mount 180, as shown in FIG. 8.

Figure 8:
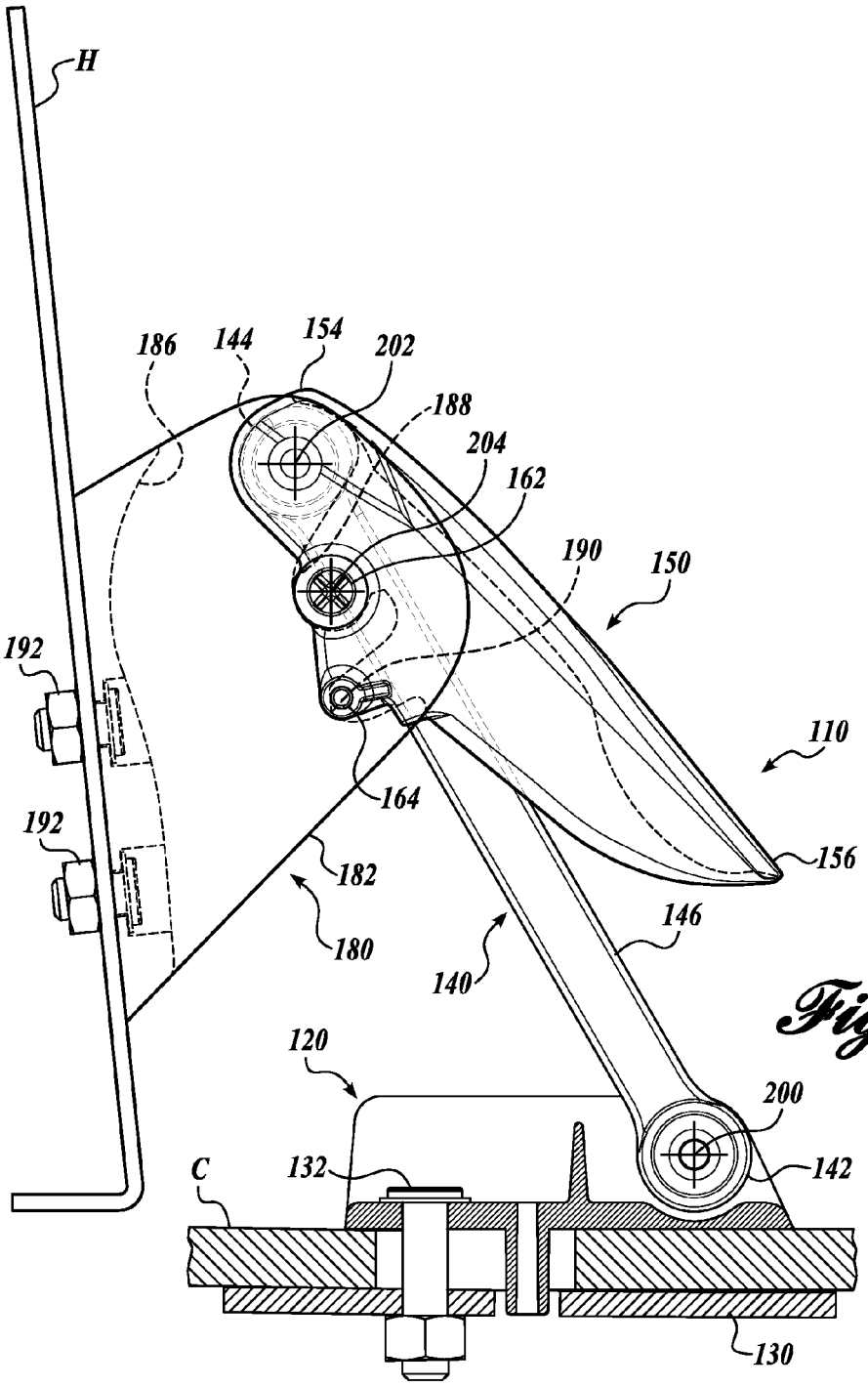
FIG. 8 is a cross-sectional view of the hood latch assembly of FIG. 1 shown in the unlatched position.

FIG. 8 depicts the hood latch assembly 100 in a closed, locked position with the hood H attached to the cab C. Further rotation of the handle 150 relative to the hood mount 180 in the clockwise direction about axis 204 is prevented by the engagement of the stop elements 164 with the second recesses 190 in the hood mount. At the same time, rotation of the handle 150 relative to the hood mount 180 in the clockwise direction about axis 204 is limited because the position of the second end 144 of the link relative to the trunnion centerline 204 provides an over-center locking feature that maintains the engagement of the stop elements 164 with the second recess 190. Thus, the hood mount 180 and, therefore, the hood H remain securely coupled to the to the cab C When the hood latch assembly is in the unlatched position, the cab C may become misaligned relative to the hood H when the gap between the hood H and cab C is greater than desired, or when the cab C and hood H are offset laterally relative to one another. If such misalignment occurs, the handle 150 may be engaged with the hood mount assembly 180 and moved into the closed, locked position as described above. However, in this instance, the elastomeric link 140 may twist, deform, or stretch to accommodate the misalignment of the cab C relative to the hood H. The elastomeric link 140 may similarly twist, deform, or stretch if the hood H and cab C become misaligned when the hood latch assembly 100 is in the closed, locked position.

Referring back to FIGS. 5-8, to move the hood latch assembly 100 back into the open, unlocked position, the handle 150 is lifted upwardly away from the cab mount assembly 120. As the handle 150 is lifted upwardly, the handle 150 pulls upwardly on the link 140. This motion stretches the link 140 and rotates the link counterclockwise about axis 202. As the link 140 rotates about axis 200 in a counterclockwise direction, the connection of the link 140 combines with the rotation of the handle 150 to drive the trunnions 162 upward. The upward movement of the trunnions 162 raises the hood mount 180 until the trunnions disengage from the recesses 188. With the trunnions 162 disengaged from the recesses, the cab mount assembly 110 is disengaged with the hood mount 180, and the hood H is free to rotate to an open position While illustrative embodiments have been illustrated and described, it will be appreciated that various changes can be made therein without departing from the spirit and scope of the invention.

The embodiments of the invention in which an exclusive property or privilege is claimed are defined as follows:

1. A latch assembly for detachably securing a vehicle hood to a cab, comprising:

(a) a hood mount securable to the hood, the hood mount comprising a first recess and a second recess; and (b) a cab mount assembly, comprising:

(i) a mounting bracket securable to the cab;

(ii) a link having a first end rotatably coupled to the mounting bracket; and (iii) a handle having a first end opposite a second end, the first end of the handle being rotatably coupled to a second end of the link about a first axis, a first trunnion extending laterally from a first side of the handle, a second trunnion extending laterally from a second side of the handle, the first and second trunnions defining a second axis, the handle rotating relative to the hood mount about the second axis as the latch assembly moves from an unlatched position, through an intermediate position, to a latched position, wherein the first and second trunnions engage the first and second recesses, respectively, to maintain the second axis in a fixed location relative to the hood mount as the handle rotates from the intermediate position to the latched position, the handle further comprising a stop extending laterally from the handle and being located a distance from the first and second axes, wherein the second axis is positioned between the first axis and the stop.

2. The latch assembly of claim 1, wherein the link is an elastomeric link.

3. The latch assembly of claim 1, wherein the hood mount comprises a third recess, the third recess engaging the stop to limit rotation of the handle relative to the hood mount when the latch assembly is in the latched position.

4. The latch assembly of claim 1, wherein movement of the latch assembly from the latched position to the unlatched position imposes a tension force on the link.

5. A vehicle, comprising:

(a) a chassis;

(b) a cab mounted to the chassis (c) a hood positioned adjacent to the cab; and (d) a latch assembly for securing the hood to the cab, comprising:

(i) a hood mount coupled to the hood, the hood mount comprising a first recess and a second recess; and (ii) a cab mount assembly, comprising a mounting bracket, a link, and a handle, the mounting bracket being coupled to the cab, the link being rotatably coupled to the mounting bracket, the handle having a first end rotatably coupled to the link about a first axis, a first trunnion extending laterally from a first side of the handle and a second trunnion extending laterally from a second side of the handle, the first and second trunnions defining a second axis, the handle rotating relative to the hood mount about the second axis as the latch assembly moves from a latched position, through an intermediate position, to an unlatched position, wherein the first and second recesses engage the first and second trunnions, respectively, to maintain the second axis in a fixed position relative to the hood mount as the handle rotates from the latched position to the intermediate position, the handle further comprising a stop extending laterally from the handle and being located a distance from the first and second axes, wherein the second axis is positioned between the first axis and the stop.

6. The latch assembly of claim 5, wherein the link is an elastomeric link.

7. The latch assembly of claim 5, wherein the hood mount comprises a third recess, the third recess engaging the stop to limit rotation of the handle relative to the hood mount when the latch assembly is in the latched position.

8. The latch assembly of claim 5, wherein movement of the latch assembly from the latched position to the unlatched position imposes a tension force on the link.

* * * * *